US006708498B2

(12) United States Patent
Stickles et al.

(10) Patent No.: US 6,708,498 B2
(45) Date of Patent: Mar. 23, 2004

(54) VENTURILESS SWIRL CUP

(75) Inventors: Richard W. Stickles, Loveland, OH (US); John L. Halpin, Pointe Claire (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/345,603

(22) Filed: Jan. 16, 2003

(65) Prior Publication Data

US 2003/0226361 A1 Dec. 11, 2003

Related U.S. Application Data

(63) Continuation of application No. 08/993,861, filed on Dec. 18, 1997, now Pat. No. 6,550,251.

(51) Int. Cl.[7] ..... F23R 3/14; F23R 3/46

(52) U.S. Cl. ..... 60/776; 60/747; 60/748

(58) Field of Search ..... 60/776, 748, 747, 60/746; 239/403, 405, 406, 466; 431/9

(56) References Cited

U.S. PATENT DOCUMENTS

| | | | | |
|---|---|---|---|---|
| 2,958,195 A | | 11/1960 | Dooley | |
| 3,589,127 A | | 6/1971 | Kenworthy et al. | |
| 3,834,159 A | * | 9/1974 | Vdoviak | 60/746 |
| 3,899,884 A | | 8/1975 | Ekstedt | |
| 3,930,368 A | | 1/1976 | Anderson et al. | |
| 3,946,552 A | | 3/1976 | Weinstein et al. | |
| 3,958,416 A | | 5/1976 | Hammond et al. | |
| 3,972,182 A | | 8/1976 | Salvi | |
| 4,012,904 A | * | 3/1977 | Nogle | 60/737 |
| 4,073,134 A | | 2/1978 | Koch | |
| 4,194,358 A | | 3/1980 | Stenger | |
| 4,584,834 A | | 4/1986 | Koshoffer et al. | |
| 4,653,278 A | | 3/1987 | Vinson et al. | |
| 4,693,074 A | | 9/1987 | Pidcock et al. | |
| 5,197,289 A | | 3/1993 | Glevicky et al. | |
| 5,237,820 A | * | 8/1993 | Kastl et al. | 60/747 |
| 5,251,447 A | | 10/1993 | Joshi et al. | |
| 5,431,019 A | * | 7/1995 | Myers et al. | 60/737 |
| 5,592,819 A | | 1/1997 | Ansart et al. | |
| 5,675,971 A | | 10/1997 | Angel et al. | |
| 5,941,075 A | * | 8/1999 | Ansart et al. | 60/748 |
| 6,550,251 B1 | * | 4/2003 | Stickles et al. | 60/776 |

* cited by examiner

*Primary Examiner*—Ted Kim
(74) *Attorney, Agent, or Firm*—William S. Andes; Francis L. Conte

(57) ABSTRACT

A swirl cup for a gas turbine engine combustor includes a tubular body having an inlet at one end for receiving a fuel injection nozzle, an outlet at an opposite end for discharging the fuel, and an annular septum therebetween. A row of first swirl vanes is attached to the septum adjacent the body inlet, and a row of second swirl vanes is attached to the septum adjacent the first swirl vanes and spaced upstream from the body outlet. Air from the first and second swirl vanes is swirled directly around the injected fuel without a flow barrier or venturi therebetween.

21 Claims, 3 Drawing Sheets

VENTURILESS SWIRL CUP

This is a continuation of U.S. application Ser. No. 08/993,861; filed Dec. 18, 1997, now U.S. Pat. No. 6,550, 251.

BACKGROUND OF THE INVENTION

The present invention relates generally to gas turbine engines, and, more specifically, to combustors therein.

In a gas turbine engine, air is compressed in a compressor and mixed with fuel in a combustor and ignited for generating hot combustion gases which flow downstream through one or more turbine stages which extract energy therefrom. Performance of the combustor affects engine efficiency and exhaust emissions. Mixing of fuel and air in turn affects combustor performance, and the prior art is crowded with combustor designs having varying degrees of effectiveness since many tradeoffs are typically required in combustor design.

Undesirable exhaust emissions include unburned hydrocarbons, carbon monoxide (CO), and nitrogen oxides (NOx). These exhaust emissions are affected by uniformity of the fuel and air mixture and amount of vaporization of the fuel prior to undergoing combustion. A typical gas turbine engine carburetor which mixes the fuel and air includes a fuel injection nozzle mounted in a swirl cup attached to the upstream, dome end of the combustor. The swirl cup typically includes two rows of swirl vanes which operate either in co-rotation or counter-rotation for swirling air around the injected fuel for forming a suitable fuel and air mixture which is discharged into the combustor for combustion.

Gas turbine engine carburetors vary in configuration significantly depending upon the specific engine design, and whether the engine is configured for aircraft propulsion or for marine and industrial (M&I) applications. NOx emissions are typically reduced by operating the combustor with a lean fuel and air mixture. However, lean mixtures typically result in poor low power performance of the combustor, increased CO and HC emissions, and are susceptible to lean flame blowout (LBO), autoignition, and flashback.

NOx emissions may also be reduced by configuring the combustor with a multiple dome, such as a double dome having two radially spaced apart rows of carburetors operated in stages. For example, the radially outer carburetors are sized and configured for pilot performance and operate continuously during all modes of engine operation from idle to maximum power. The radially inner carburetors are sized and configured for main operation and are fueled only above idle for higher power operation of the engine.

Accordingly, the required amount of fuel for operating the combustor over the different power settings may be selectively split between the outer and inner carburetors for obtaining suitable combustor performance with reduced exhaust emissions.

Performance of the combustor is also evaluated by conventional profile factor and pattern factor which indicate relative uniformity of radial and circumferential temperature distribution from the combustion gases at the exit of the combustor which affect efficiency and life of the high pressure turbine which firstly receives the combustion gases from the combustor.

A typical swirl cup used in both the outer and inner carburetors includes a tubular member in the form of a venturi disposed between the two rows of swirl vanes. The venturi has two primary purposes including a throat of minimum flow area sized for accelerating the injected fuel and swirl air from a primary row of swirl vanes to a suitably high velocity to reduce carbon formation on the face of the fuel injection nozzle and to prevent the flame front in the combustor from travelling forwardly into the swirl cup toward the fuel nozzle. The venturi also has an inner surface along which the fuel from the nozzle may form a film which may be airblast atomized by the swirl air flowing through the swirl cup.

In view of these many related components affecting combustion performance, it is desired to further improve combustor performance due to improved swirl cup design.

BRIEF DESCRIPTION OF THE INVENTION

A swirl cup for a gas turbine engine combustor includes a tubular body having an inlet at one end for receiving a fuel injection nozzle, an outlet at an opposite end for discharging the fuel, and an annular septum therebetween. A row of first swirl vanes is attached to the septum adjacent the body inlet, and a row of second swirl vanes is attached to the septum adjacent the first swirl vanes and spaced upstream from the body outlet. Air from the first and second swirl vanes is swirled directly around the injected fuel without a flow barrier or venturi therebetween.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
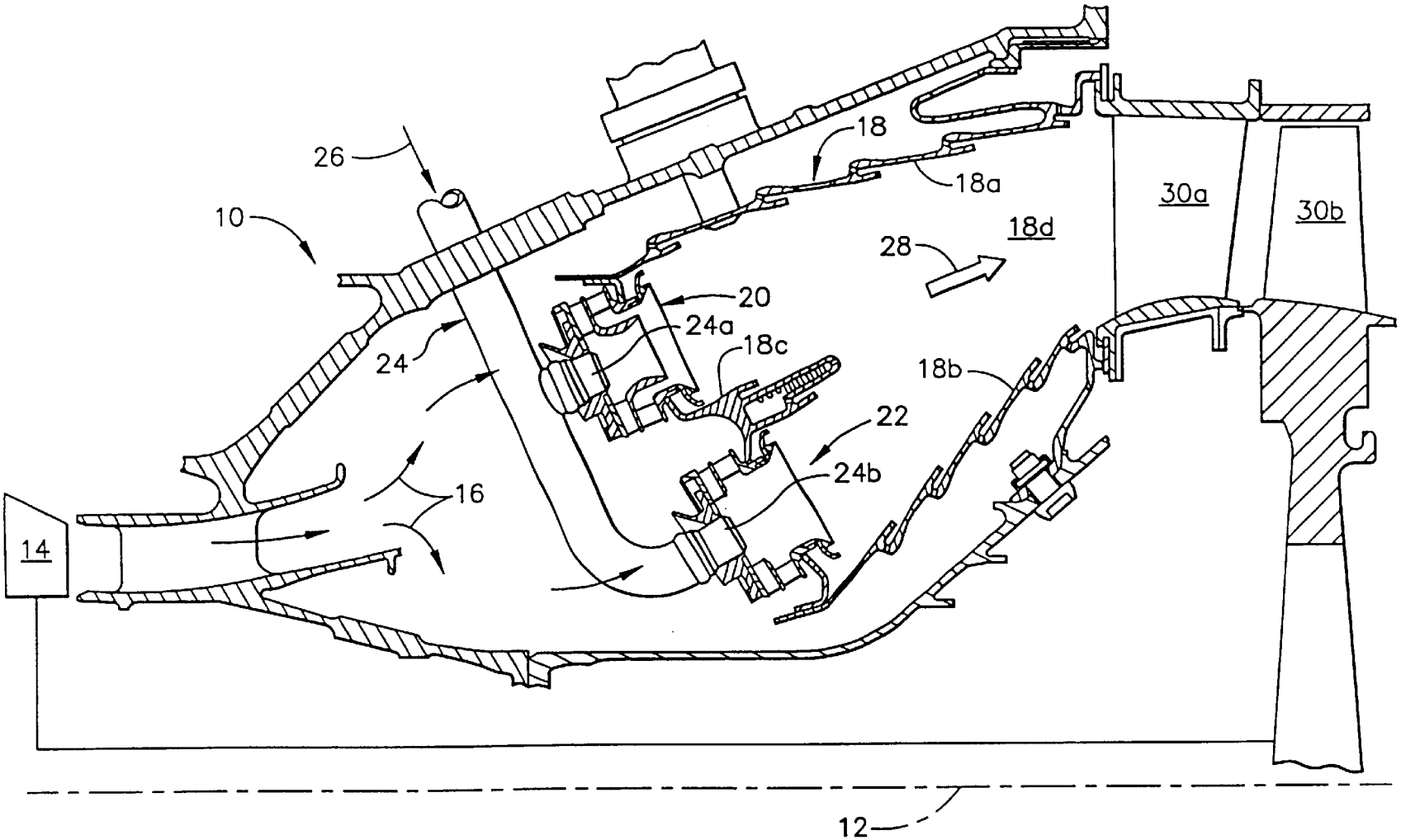
FIG. 1 is a schematic axial sectional view through a portion of an exemplary gas turbine engine including a combustor in accordance with a preferred embodiment of the present invention.

Illustrated schematically in FIG. 1 is a portion of an exemplary gas turbine engine 10 which is axisymmetrical about a longitudinal or axial centerline axis 12. The engine 10 includes a compressor 14 which may take any conventional form for providing compressed air 16 into an annular combustor 18. The combustor 18 is conventionally configured with a radially outer liner 18*a*, a radially inner liner 18*b*, and an annular dome 18*c* joined to the upstream ends thereof to define an annular combustor chamber 18*d*.

In the preferred embodiment, the combustor dome 18 is a double-dome in which are conventionally mounted a row of radially outer or pilot swirl cups 20, and a row of radially inner or main swirl cups 22 configured in accordance with an exemplary embodiment of the present invention. A common fuel injector 24 includes a pair of radially outer and inner fuel injection nozzles 24*a, b* disposed in respective ones of the outer and inner swirl cups 20,22 for injecting fuel 26 therein in a conventional manner.

The air 16 and fuel 26 are mixed together in the separate swirl cups 20,22 for providing a suitable fuel and air mixture which is discharged into the combustion chamber 18*d* and conventionally ignited for generating hot combustion gases 28 which are discharged from the combustor 18 into a conventional high pressure turbine nozzle 30*a* and cooperating high pressure turbine 30*b*. The turbine 30*b* includes a row of turbine blades extending radially outwardly from a rotor disk, with the disk being suitably joined to the compressor 14 for providing power thereto during operation.

The combustor 18 illustrated in FIG. 1 is configured with the double dome 18*c* and two rows of swirl cups 20,22 for reducing exhaust emissions during operation of the engine from idle to maximum power while obtaining acceptable combustor performance. The fuel injector 24 and outer swirl cups 20 may take any conventional configuration, and cooperate with the inner swirl cups 22 which are suitably modified in accordance with the present invention for further reducing exhaust emissions and further improving performance of the combustor.

Figure 2:
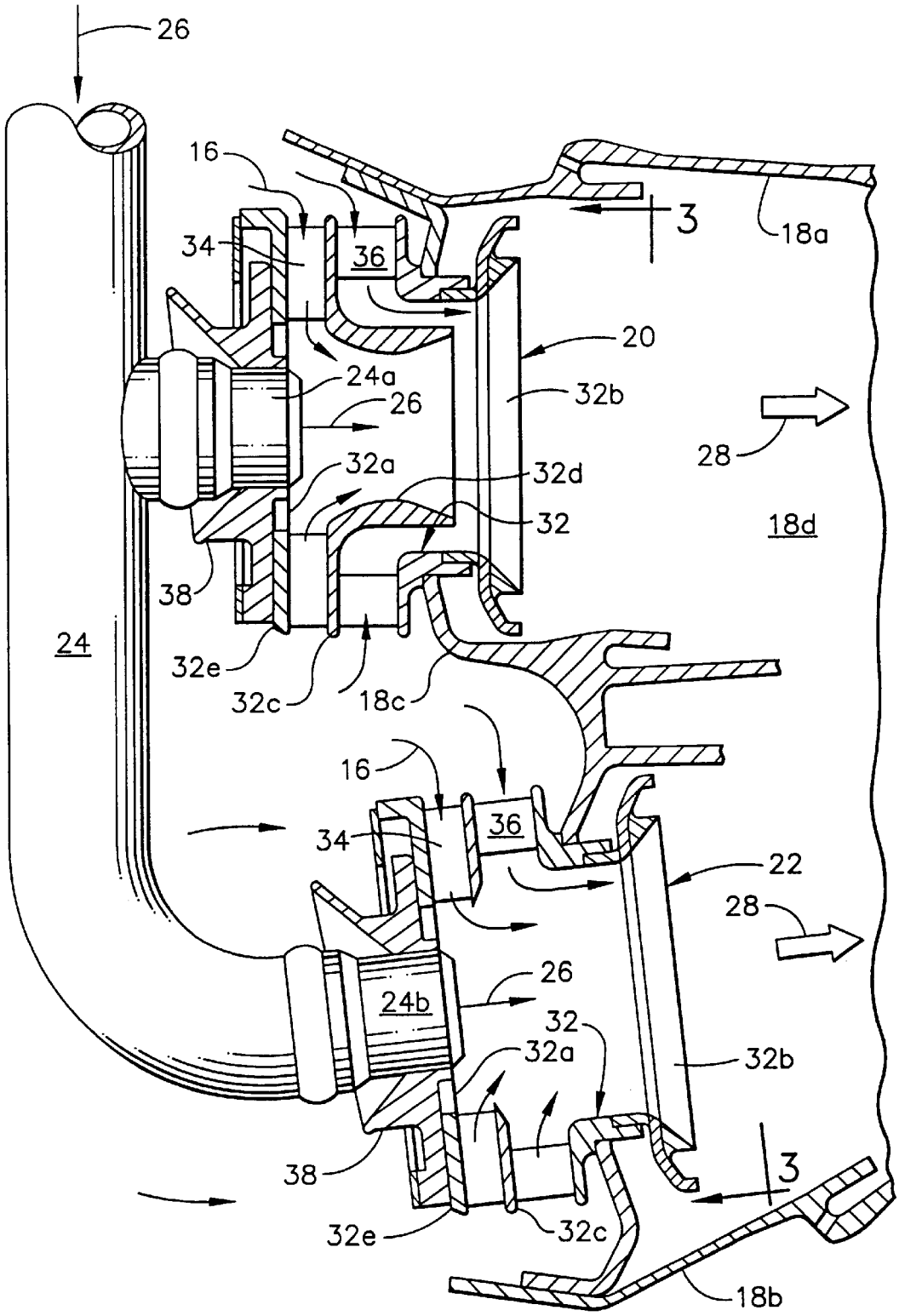
FIG. 2 is an enlarged elevational, partly sectional view of the dome end of the combustor illustrated in FIG. 1 showing a pair of swirl cups and cooperating fuel injector in accordance with an exemplary embodiment of the present invention.

More specifically, the improved inner swirl cup 22 cooperating with a corresponding one of the outer swirl cups 20 and common fuel injector 24 are illustrated in more particularity in FIG. 2 in accordance with an exemplary embodiment of the present invention. Each of the circumferentially spaced apart inner swirl cups 22 includes a tubular body 32 which is axisymmetric about its own longitudinal or axial centerline axis, and includes an annular inlet 32*a* at a forward or upstream end thereof for receiving the inner fuel nozzle 24*b* and the fuel 26 therefrom. The body 32 also includes an annular outlet 32*b* at an opposite downstream or aft axial end thereof disposed coaxially with the body inlet 32*a* for discharging the fuel 26 into the combustion chamber 18*d*. The body 32 also includes an annular septum 32*c* in the form of a flat disk with a central aperture therethrough disposed axially between the body inlet 32*a* and outlet 32*b*.

Figure 3:
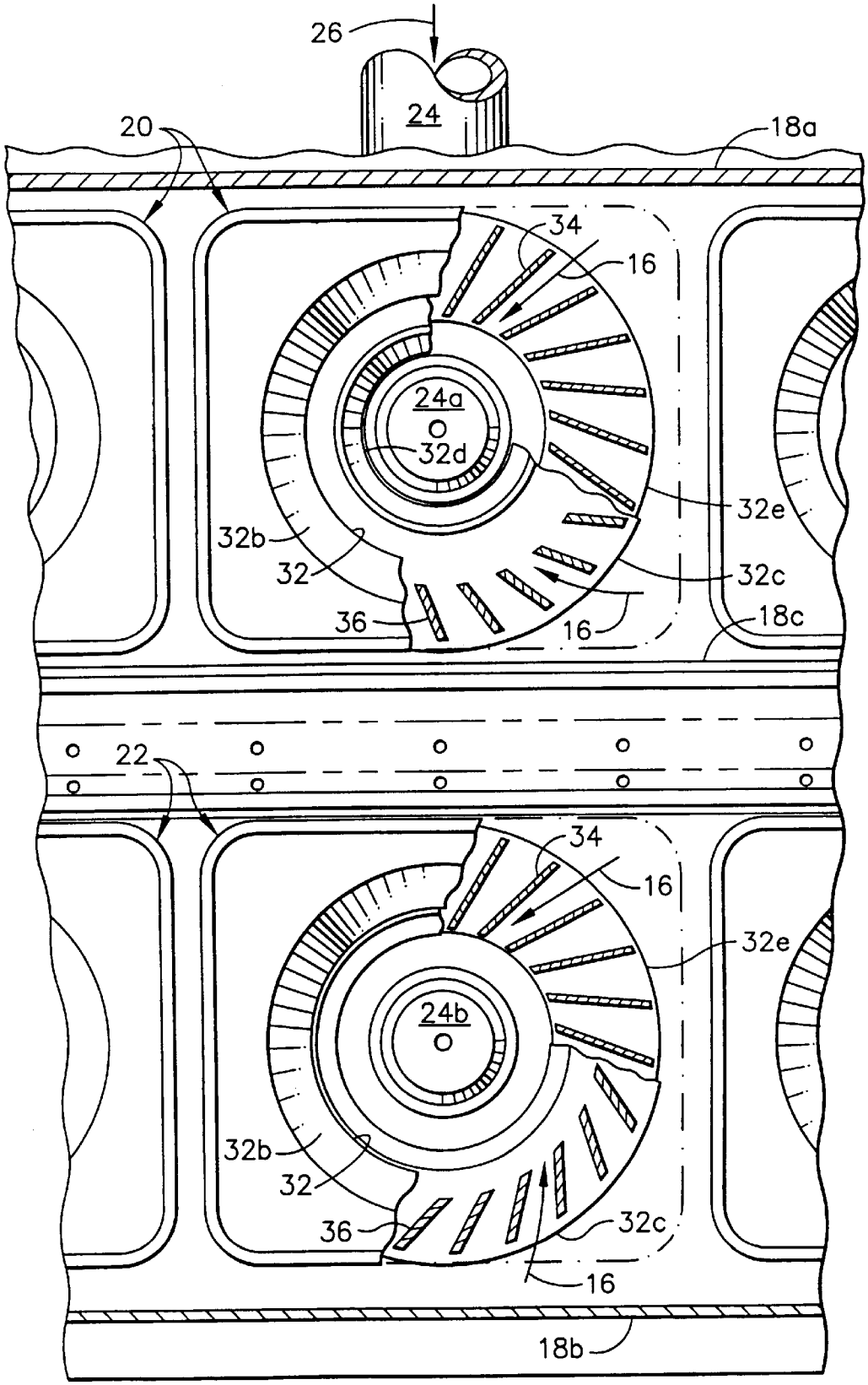
FIG. 3 is an aft-facing-forward view of the swirl cups illustrated in FIG. 2 and taken along line 3—3.

Referring to both FIGS. 2 and 3, each of the inner swirl cups 22 further includes means in the form of a first or primary row of circumferentially spaced apart first swirl vanes 34 fixedly attached to the forward face of the septum 32*c* adjacent to the body inlet 32*a* for channeling into the body 32 first swirl air in a first swirl direction, which is counterclockwise for example as shown in FIG. 3 circumferentially around the injected fuel 26. Means in the form of a second or secondary row of circumferentially spaced apart second swirl vanes 36 are fixedly attached to the aft face of the septum 32*c* downstream from and adjacent to the first swirl vanes 34, and are spaced upstream from the body outlet 32*b* for channeling into the body 32 additional, or second swirl air in a second swirl direction, also counterclockwise for example as illustrated in FIG. 3, directly around both the injected fuel 26 and the first swirl air.

As shown in FIG. 2, the septum 32*c* terminates in accordance with the present invention axially between the first and second swirl vanes 34,36 without a radial flow barrier or venturi therebetween for allowing direct and immediate contact between the air discharged from the swirl vanes 34,36. But for the present invention as described in more detail hereinbelow, the inner swirl cups 22 are conventionally configured without a conventional flow barrier or venturi between the swirl vanes 34,36.

This is more apparent by examining the cooperating outer swirl cup 20 illustrated in FIG. 2 which is similarly configured in a conventional manner, but includes a tubular venturi 32*d* integrally formed with the radially inner end of the septum 32*c* and extending axially aft therefrom. The venturi 32*d* is defined by an inner surface which converges to a throat of minimum flow area to accelerate flow, and then diverges to its outlet. The outer surface of the venturi is typically straight cylindrical. The venturi accelerates the fuel and first swirl air while radially separating the second swirl air therefrom up to its outlet.

In both the outer and inner swirl cups 20,22 the first and second swirl vanes 34,36 may be formed in a common casting with the main body 32 including the septum 32*c*. In this exemplary embodiment, the body 32 also includes an integral forward plate 32*e* commonly cast with the forward ends of the first swirl vanes 34 to provide a conventional mount containing a conventional floating ferrule 38 in which the respective fuel nozzles 24*a,b* are slidably mounted. The bodies 32 themselves are suitably fixedly joined in complementary apertures through the combustor dome 18*c* and may be welded or brazed therein.

Since the outer swirl cups 20 are provided for pilot performance of the combustor during all modes of operation from idle to maximum power, they are suitably sized for mixing pilot portions of the fuel 26 with pilot portions of the air 16 through the first and second swirl vanes 34,36 thereof. Correspondingly, the inner swirl cups 22 are specifically sized for main performance of the combustor at power setting greater than idle and up to maximum power. Other than size and the absence of the venturi 32*d* in the inner swirl cups 22, the outer and inner swirl cups 20,22 may be similarly configured in a conventional manner.

Although some form of the venturi 32*d* or other radial flow barrier between the first and second swirl vanes 34,36 is used in conventional combustors, it has been discovered in accordance with the present invention that improved fuel and air mixing with a correspondingly longer premixer residence time in the inner swirl cups 22 may be obtained by eliminating the venturi 32*d* therein. In this way, the air from the second swirl vanes 36 directly and immediately contacts the air from the first swirl vanes 34 and injected fuel 26 therein without the barrier or delay as in the outer swirl cups 20. Improved fuel atomization and vaporization are obtained in the inner swirl cups 22, along with improved uniformity of the fuel and air mixture discharged therefrom into the combustion chamber 18*d*.

The venturiless inner swirl cups 22 illustrated in FIGS. 2 and 3 allow an improved method of operation of the combustor 18 by firstly injecting the fuel 26 into the upstream end of the inner swirl cup 22. This is followed in turn by firstly swirling a portion of the air 16 in a first swirl direction into the inner swirl cup 22 coaxially around the injected fuel 26, followed in turn by secondly swirling another portion of the air 16 in a second swirl direction into the inner swirl cup 22 coaxially around both the injected fuel 26 and the firstly swirled air without a radial flow barrier or venturi therebetween. This improves the premixing of the fuel and air inside the inner swirl cups 22, which mixture is then discharged into the combustion chamber 18*d* for being ignited and undergoing combustion to form the combustion gases 28.

As illustrated in FIGS. 2 and 3, the first and second swirl vanes 34,36 are preferably inclined radially inwardly to swirl the air 16 radially inwardly and circumferentially around the injected fuel 26. This is in contrast to conventional axial swirl vanes which are inclined in the circumferential direction for axially swirling airflow in a manner related to but different than the radial swirling effected by the radial swirl vanes 34,36. However, the invention may be extended to axial swirl vanes if desired.

In the preferred embodiment illustrated in FIG. 3, the first and second swirl vanes 34,36 are similarly inclined, or co-inclined, for effecting equal first and second swirl directions which are counterclockwise in the FIG. 3 example. In this way, the first and second swirl vanes 34,36 swirl the respective air portions radially around the injected fuel 26 in co-rotation.

This is in contrast with the orientation of the first and second swirl vanes 34,36 of the outer swirl cups 20 as illustrated in FIGS. 2 and 3. In the outer swirl cups 20, the first and second swirl vanes 34,36 are oppositely inclined radially inwardly for effecting counter-rotation of the respective air portions therefrom with opposite first and second swirl directions, with clockwise rotation being illustrated for the first swirl vanes 34 and counterclockwise rotation being illustrated for the second swirl vanes 36 in this exemplary embodiment.

Although both counter-rotation and co-rotation swirl vanes are conventional in the art, tests have shown the advantage of co-rotation due to the first and second swirl vanes 34,36 of the inner swirl cup 22 in the preferred embodiment. For example, a significant reduction in carbon monoxide (CO) emissions have been confirmed over a significant range of swirler equivalency ratio, or fuel/air ratio, when comparing the inner swirl cups 22 to a baseline or similar design using a conventional venturi like that illustrated for the outer swirl cups 20.

In order to offset the loss of the flow accelerating effect by the missing venturi in the inner swirl cup 22, the body outlets 32*b* may be suitably reduced in flow area for accelerating the flow therethrough. The body outlets 32*b* are otherwise conventionally configured and include an integral splash-plate in a conventional manner.

An additional and unexpected advantage of the venturi-less swirl cup 22 according to the present invention is attributable to the double dome design illustrated in the Figures. As indicated above, combustor performance is also evaluated on the conventionally known profile factor which is an indication of the radial uniformity of temperature of the combustion gases 28 discharged from the outlet of the combustor 18.

During engine idle, injection of the fuel 26 from the inner nozzles 24*b* into the inner swirl cups 22 is stopped, while the respective air portions through the first and second swirl vanes 34,36 in the inner swirl cups 22 continues to flow and simply mixes together without fuel inside the inner swirl cups 22 and without the flow barrier venturi therebetween. During idle, the fuel 26 is injected solely from the outer nozzles 24*a* into the corresponding outer swirl cups 20, with the fuel and air mixture being ignited for sustaining the combustion process. However, the swirled air from the inner swirl cups 22 continues to mix with the combustion gases 28 during travel through the combustor 18 and improves the profile factor as confirmed by tests.

The venturi 32*d* is kept in the outer swirl cups 20 for its conventional benefits including flame stability and lean flame blowout margin. This is particularly important for idle operation since the inner swirl cups 20 are venturiless.

As indicated above, combustor performance is evaluated using various evaluation criteria, and tradeoffs in performance are typically required in view of specific combustion and fuel injection designs. The present invention introduces yet another variable in combustor design in eliminating the venturi 32*d* in the inner swirl cups 22 for providing enhanced performance of the combustor including reduction in exhaust emissions such as carbon monoxide, and an improved profile factor in the double-dome configuration disclosed.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A swirl cup for defining with a fuel injection nozzle a carburetor in a gas turbine combustor, said swirl cup comprising:

a tubular body including at one end a forward plate having an inlet for receiving said fuel injection nozzle to inject fuel into said body, an outlet at an opposite axial end for discharging said fuel into said combustor, and an annular septum axially therebetween;

a row of first swirl vanes attached to said forward plate and to a forward side of said septum aft of said body inlet for channeling into said body air in a first swirl direction around said injected fuel; and a row of second swirl vanes attached to an aft side of said septum and spaced upstream from said body outlet for channeling into said body additional air in a second swirl direction directly around both said injected fuel and said first swirl air, with said septum terminating radially inward of said first swirl vanes at a central aperture and axially forward of said second swirl vanes without a flow barrier extending aft from said septum between said rows of first and second swirl vanes.

2. A swirl cup according to claim 1 wherein said septum comprises a disk having said central aperture disposed axially between said first and second swirl vanes without a radial flow barrier between said first and second swirl vanes for allowing direct contact between said air discharged therefrom.

3. A swirl cup according to claim 2 wherein said first and second swirl vanes are inclined radially inwardly to swirl said air radially inwardly and circumferentially around said injected fuel.

4. A swirl cup according to claim 3 wherein said first and second swirl vanes are similarly inclined for effecting co-rotation of said air with equal first and second swirl directions.

5. A swirl cup according to claim 3 in combination with said combustor as an inner swirl cup, and further comprising a similarly configured outer swirl cup for receiving said fuel from a common fuel injector having a pair of said nozzles, with said outer swirl cup further including a venturi extending axially aft from said septum thereof for radially separating said second swirl air from said first swirl air and injected fuel.

6. An apparatus according to claim 5 wherein:

said first and second swirl vanes of said inner swirl cup are similarly inclined for effecting co-rotation of said air with equal first and second swirl directions; and said first and second swirl vanes of said outer swirl cup are oppositely inclined for effecting counter-rotation of said air with opposite first and second swirl directions.

7. A swirl cup according to claim 2 further comprising a tubular ferrule mounted to said forward plate for receiving said fuel nozzle in floating movement relative to said forward plate.

8. A swirl cup according to claim 2 wherein said septum further comprises a flat disk disposed substantially parallel with said forward plate on opposite axial sides of said first swirl vanes.

9. A swirl cup according to claim 2 wherein said second swirl vanes are radially shorter than said first swirl vanes, and terminate radially outwardly of said septum aperture for swirling said air around said first swirl air.

10. A swirl cup according to claim 2 wherein said first and second swirl vanes and tubular body comprise a common casting integrally including said forward plate and septum.

11. A swirl cup according to claim 2 in combination with said fuel injection nozzle slidably mounted in said body inlet in said forward plate to define said carburetor for injecting into said combustor a fuel and air mixture for combustion in said combustor.

12. A method for injecting fuel and air through a tubular venturiless swirl cup into a gas turbine engine combustor comprising:

injecting said fuel through a central aperture inlet at an upstream end of said venturiless swirl cup;

firstly swirling a portion of said air in a first swirl direction into said swirl cup coaxially around said injected fuel and following in turn said fuel injection, and upstream of an annular septum of said swirl cup;

secondly swirling another portion of said air in a second swirl direction into said swirl cup coaxially around both said injected fuel and said firstly swirled air, and following in turn said fuel injection and first swirling, and downstream of said annular septum without a radial flow barrier therebetween; and discharging from said swirl cup a premixture of said injected fuel and firstly and secondly swirled air into said combustor for being ignited in said combustor.

13. A method according to claim 12 wherein said first and second swirling steps are effected downstream of said fuel injection without a venturi therebetween for permitting direct contact of said first and second swirling air.

14. A method according to claim 13 wherein said first and second swirling steps swirl said air radially inwardly around said injector fuel in co-rotation, with said second swirl direction being equal to said first swirl direction.

15. A method according to claim 14 wherein said combustor includes radially outer and inner swirl cups and said method further comprises:

injecting said fuel into said outer swirl cup, and firstly and secondly swirling said air portions around said injected fuel therein with a flow barrier venturi between said first and second swirl air portions; and stopping injection of said fuel into said inner swirl cup at a low power idle mode of operation, while firstly and secondly swirling said air portions therein without said flow barrier therebetween.

16. A carburetor for injecting fuel and air into a gas turbine engine combustor comprising:

a swirl cup including at one end a forward plate, an outlet at an opposite axial end, and an annular septum disposed axially therebetween in a common casting;

means for injecting said fuel through a central inlet aperture in said forward plate of said swirl cup;

means for firstly swirling a portion of said air in a first swirl direction into said swirl cup coaxially around said injected fuel downstream of said forward plate and upstream of said septum; and means for secondly swirling another portion of said air in a second swirl direction into said swirl cup downstream of said septum and coaxially around both said injected fuel and said firstly swirled air, with said septum terminating radially inward of said first swirling means at a central aperture and axially forward of said second swirling means without a radial flow barrier between said first and second swirling means for discharge as a fuel and air mixture through said swirl cup outlet into said combustor.

17. A method for injecting fuel and air as carbureted mixtures through radially outer swirl cups having venturis, and through similarly configured radially inner, venturiless swirl cups into a gas turbine engine combustor comprising:

injecting said fuel into said outer swirl cup, and firstly and secondly swirling portions of said air around said injected fuel therein with a radial flow barrier venturi between said first and second swirl air portions; and injecting said fuel into said inner swirl cup, and firstly and secondly swirling portions of said air around said injected fuel therein without a corresponding radial flow barrier venturi between said first and second swirl air portions in said inner swirl cup for reducing exhaust emissions from said combustor.

18. A method according to claim 17 wherein:

said outer swirl cup is operated to mix pilot portions of said fuel with pilot portions of said air; and said inner swirl cup is operated to mix different main portions of said fuel with different main portions of said air.

19. A method according to claim 18 wherein said inner swirl cup is operated with reduced flow area for accelerating said carbureted mixture therefrom into said combustor to offset flow acceleration from the omission of said venturi therein.

20. A method according to claim 18 wherein:

said outer swirl cup is operated to inject fuel into said combustor during all modes of operation from idle to maximum power; and said inner swirl cup is operated without fuel injection therethrough during said idle mode, and operated with fuel injection at power settings above said idle mode.

21. A method according to claim 20 wherein:

said air portions in said outer swirl cup are firstly and secondly swirled in counter-rotation around said injected fuel therein; and said air portions in said inner swirl cup are firstly and secondly swirled in co-rotation around said injected fuel therein.

* * * * *